US007588649B2

(12) United States Patent
Blejde et al.

(10) Patent No.: US 7,588,649 B2
(45) Date of Patent: Sep. 15, 2009

(54) CASTING STEEL STRIP

(75) Inventors: Walter N. Blejde, Brownsburg, IN (US); Rama Ballav Mahapatra, Brighton-le-Sands (AU); Lazar Strezov, Adamstown Heights (AU)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/419,684

(22) Filed: May 22, 2006

(65) Prior Publication Data

US 2006/0196630 A1 Sep. 7, 2006

Related U.S. Application Data

(60) Division of application No. 10/761,953, filed on Jan. 21, 2004, now Pat. No. 7,048,033, which is a continuation-in-part of application No. 10/243,699, filed on Sep. 13, 2002, now abandoned.

(60) Provisional application No. 60/322,261, filed on Sep. 14, 2001.

(51) Int. Cl.
*C22C 38/00* (2006.01)
*B22D 11/06* (2006.01)

(52) U.S. Cl. ..... 148/320; 164/480

(58) Field of Classification Search ..... 164/480, 164/428; 148/320

See application file for complete search history.

(56) References Cited

U.S. PATENT DOCUMENTS

| | | | |
|---|---|---|---|
| 4,073,643 | A | 2/1978 | Kumai et al. |
| 4,152,140 | A | 5/1979 | Hori et al. |
| 4,468,249 | A | 8/1984 | Lehman |
| 4,746,361 | A | 5/1988 | Pielet et al. |
| 5,720,336 | A | 2/1998 | Strezov |
| 5,934,359 | A | 8/1999 | Strezov |
| 6,059,014 | A | 5/2000 | Strezov |
| 6,073,679 | A | 6/2000 | Strezov |
| 6,491,089 | B1 | 12/2002 | Poirier et al. |
| 6,547,849 | B2 | 4/2003 | Gross et al. |
| 6,558,486 | B1 | 5/2003 | Strezov et al. |
| 6,942,013 | B2 | 9/2005 | Strezov et al. |
| 2003/0111206 | A1 | 6/2003 | Blejde et al. |
| 2004/0177944 | A1 | 9/2004 | Blejde et al. |
| 2004/0177945 | A1 | 9/2004 | Blejde et al. |

FOREIGN PATENT DOCUMENTS

| | | | |
|---|---|---|---|
| EP | 0732163 | | 9/1996 |
| JP | 57134249 | | 8/1982 |
| JP | 58113318 | | 7/1983 |
| JP | 62050054 | | 3/1987 |
| JP | 02205618 | | 8/1990 |
| JP | 03291139 | | 12/1991 |
| JP | 5-255816 | A | 10/1993 |
| JP | 5-255861 | | 10/1993 |
| JP | 5-255861 | A * | 10/1993 |
| JP | 405255816 | A * | 10/1993 |
| JP | 2001-123245 | | 5/2001 |
| JP | 2001-342543 | | 12/2001 |
| JP | 2001-355039 | | 12/2001 |
| JP | 2003-138340 | | 5/2003 |
| JP | 2004-018971 | | 1/2004 |
| JP | 2004-211157 | | 7/2004 |
| KR | 2002-0040210 | | 6/2002 |
| KR | 2002-0048034 | | 6/2002 |
| KR | 2002-0048199 | | 6/2002 |
| WO | 9855251 | | 12/1998 |
| WO | 0007753 | | 2/2000 |
| WO | 0226422 | | 4/2002 |
| WO | 03024644 | | 3/2003 |
| WO | 2005031021 | | 4/2005 |
| WO | 2008/025096 | | 3/2008 |

OTHER PUBLICATIONS

Recent Development in Project M the Joint Development of Low Carbon Steel Strip Casting by BHP and IHI, presented at the METEC Congress 99, Dusseldorf Germany (Jun. 13-15, 1999), p. 176-181.

Ginzurg, V. and Ballas, R.; Flat Rolling Fundamentals; Marcel Decker, Inc., New York, NY; pp. 50-52.

PCT/AU2007/903665 International Search Report.

"Light Microscopy of Carbon Steels," Leonard E. Samuels, (Definition of "carbon steel") p. 430 (Copyright 1999 by ASM International).

PCT/AU2007/001279 Written Opinion.

* cited by examiner

*Primary Examiner*—Kevin P Kerns
(74) *Attorney, Agent, or Firm*—Hahn, Loeser & Parks, LLP

(57) ABSTRACT

A method of producing strip including the steps of assembling a pair of casting rolls with a nip between them, introducing between the casting rolls to form a casting pool of molten carbon steel having a total oxygen content of at least 70 ppm, usually less than 250 ppm, and a free oxygen content 20 and 60 ppm, counter rotating the casting rolls, solidifying the molten steel on the rolls to form metal shells with levels of oxide inclusions reflected by the total oxygen content of the molten steel, and forming thin steel strip through the nip between the casting rolls from the solidified shells. The molten steel may have a total oxygen content is at least 100 ppm and the free oxygen content may be between 30 and 50 ppm. A unique steel strip may be obtained using the method having ductile properties.

8 Claims, 15 Drawing Sheets

SiO2
Al2O3
MnO
wt%SiO2
wt%Al2O3
Wt%MnO
MnOAl2O3
SiO2
3Al2O3 2SiO2
Al2O
MnO
3MnO3SiO2Al2O3
MnOSiO2
2MnOSiO2
1200
1300
1400
1500
1600
1700
1800
1900
2000

CASTING STEEL STRIP

RELATED APPLICATIONS

This application is a divisional application of Ser. No. 10/761,953 filed Jan. 21, 2004, now U.S. Pat. No. 7,048,033, which is a continuation-in-part application of application Ser. No. 10/243,699, filed Sep. 13, 2002, now abandoned, which claims priority to and the benefit of U.S. Provisional Patent Application No. 60/322,261, filed Sep. 14, 2001, the disclosures of which are expressly incorporated herein by reference.

BACKGROUND AND SUMMARY OF THE INVENTION

This invention relates to the casting of steel strip. It has particular application to continuous casting of thin steel strip in a twin roll caster.

In twin roll casting, molten metal is introduced between a pair of counter-rotated horizontal casting rolls, which are cooled so that metal shells solidify on the moving roll surfaces, and are brought together at the nip between them to produce a solidified strip product delivered downwardly from the nip. The term "nip" is used herein to refer to the general region at which the rolls are closest together. The molten metal may be poured from a ladle into a smaller vessel from which it flows through a metal delivery nozzle located above the nip forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

When casting thin steel strip in a twin roll caster, the molten steel in the casting pool will generally be at a temperature of the order of 1500° C. and above, and therefore high cooling rates are needed over the casting roll surfaces. It is important to achieve a high heat flux and extensive nucleation on initial solidification of the steel on the casting surfaces to form the metal shells. U.S. Pat. No. 5,720,336 describes how the heat flux on initial solidification can be increased by adjusting the steel melt chemistry so that a substantial proportion of the metal oxides formed as deoxidation products are liquid at the initial solidification temperature so as to form a substantially liquid layer at the interface between the molten metal and the casting surface. As disclosed in U.S. Pat. Nos. 5,934,359 and 6,059,014 and International Application PCT/AU99/00641, nucleation of the steel on initial solidification can be influenced by the texture of the casting surface. In particular International Application PCT/AU99/00641 discloses that a random texture of peaks and troughs can enhance initial solidification by providing potential nucleation sites distributed throughout the casting surfaces. We have now determined that nucleation is also dependent on the presence of oxide inclusions in the steel melt and that, surprisingly, it is not advantageous in twin roll strip casting to cast with "clean" steel in which the number of inclusions formed during deoxidation has been minimized in the molten steel prior to casting.

Steel for continuous casting is subjected to deoxidation treatment in the ladle prior to pouring. In twin roll casting, the steel is generally subjected to silicon manganese ladle deoxidation. However, it is possible to use aluminum deoxidation with calcium addition to control the formation of solid $Al_2O_3$ inclusions that can clog the fine metal flow passages in the metal delivery system through which molten metal is delivered to the casting pool. It has hitherto been thought desirable to aim for optimum steel cleanliness by ladle treatment and minimize the total oxygen level in the molten steel. However we have now determined that lowering the steel oxygen level reduces the volume of inclusions, and if the total oxygen content and free oxygen content of the steel are reduced below certain levels the nature of the intimate contact between the steel and roll surfaces can be adversely effected to the extent that there is insufficient nucleation to generate rapid initial solidification and high heat flux. Molten steel is trimmed by deoxidation in the ladle such that the total oxygen and free oxygen contents fall within ranges which ensure satisfactory solidification on the casting rolls and production of a satisfactory strip product. The molten steel contains a distribution of oxide inclusions (typically MnO, CaO, $SiO_2$ and/or $Al_2O_3$) sufficient to provide an adequate density of nucleation sites on the roll surfaces for initial and continued solidification and the resulting strip product exhibits a characteristic distribution of solidified inclusions and surface characteristics.

There is provided a method of casting steel strip comprising:

assembling a pair of cooled casting rolls having a nip between them and confining closures adjacent the ends of the nip;

introducing molten low carbon steel between said pair of casting rolls to form a casting pool between the casting rolls with said closures confining the pool adjacent the ends of the nip, with the molten steel having a total oxygen content in the casting pool of at least 70 ppm, usually less than 250 ppm, and a free-oxygen content of between 20 and 60 ppm;

counter rotating the casting rolls and solidifying the molten steel to form metal shells on the casting rolls with levels of oxide inclusions reflected by the total oxygen content of the molten steel to promote the formation of thin steel strip; and forming solidified thin steel strip through the nip between the casting rolls to produce a solidified steel strip delivered downwardly from the nip.

There is also provided a method of casting steel strip comprising:

assembling a pair of cooled casting rolls having a nip between them and confining closures adjacent the ends of the nip;

introducing molten low carbon steel between said pair of casting rolls to form a casting pool between the casting rolls with said closures confining the pool adjacent the ends of the nip, with the molten steel having a total oxygen content in the casting pool of at least 100 ppm, usually less than 250 ppm, and a free-oxygen content between 30 and 50 ppm;

counter rotating the casting rolls and solidifying the molten steel to form metal shells on the casting rolls with levels of oxide inclusions reflected by the total oxygen content of the molten steel to promote the formation of thin steel strip; and forming solidified thin steel strip through the nip between the casting rolls to produce a solidified steel strip delivered downwardly from the nip.

The total oxygen content of the molten steel in the casting pool may be about 200 ppm or about 80-150 ppm. The total oxygen content includes free oxygen content between 20 and 60 ppm or between 30 and 50 ppm. The total oxygen content includes, in addition to the free oxygen, the deoxidation inclusions present in the molten steel at the introduction of the molten steel into the casting pool. The free oxygen is formed into solidification inclusions adjacent the surface of the casting rolls during formation of the metal shells and cast strip. These solidification inclusions are liquid inclusions that improve the heat transfer rate between the molten metal and the casting rolls, and in turn promote the formation of the metal shells. The deoxidation inclusions also promote the presence of free oxygen and in turn solidification inclusions, so that the free oxygen content is related to the deoxidation inclusion content.

The low carbon steel may have a carbon content in the range 0.001% to 0.1% by weight, a manganese content in the range 0.01% to 2.0% by weight and a silicon content in the range 0.01% to 10% by weight. The steel may have an aluminum content of the order of 0.01% or less by weight. The aluminum may for example be as little as 0.008% or less by weight. The molten steel may be a silicon/manganese killed steel.

The oxide inclusions are solidification inclusions and deoxidation inclusions. The solidification inclusions are formed during cooling and solidification of the steel in casting, and the deoxidation inclusions are formed during deoxidation of the molten steel before casting. The solidified steel may contain oxide inclusions usually comprised of any one or more of MnO, $SiO_2$ and $Al_2O_3$ distributed through the steel at an inclusion density in the range 2 gm/cm$^3$ and 4 gm/cm$^3$.

The molten steel may be refined in a ladle prior to introduction between the casting rolls to form the casting pool by heating a steel charge and slag forming material in the ladle to form molten steel covered by a slag containing silicon, manganese and calcium oxides. The molten steel may be stirred by injecting an inert gas into it to cause desulphurization, and then injecting oxygen, to produce molten steel having the desired total oxygen content of at least 70 ppm, usually less than 250 ppm, and a free oxygen content between 20 and 60 ppm in the casting pool. As described above, the total oxygen content of the molten steel in the casting pool may be at least 100 ppm and the free oxygen content between 30 and 50 ppm. In this regard, we note that the total oxygen and free oxygen contents in the ladle are generally higher than in the casting pool, since both the total oxygen and free oxygen contents of the molten steel are directly related to its temperature, with these oxygen levels reduced with the lowering of the temperature in going from the ladle to the casting pool. The desulphurization may reduce the sulphur content of the molten steel to less than 0.01% by weight.

The thin steel strip produced by continuous twin roll casting as described above has a thickness of less than 5 mm and is formed of a cast steel containing solidified oxide inclusions. The distribution of the inclusions in the cast strip may be such that the surface regions of the strip to a depth of 2 microns from the outer faces contain solidified inclusions to a per unit area density of at least 120 inclusions/mm$^2$.

The solidified steel may be a silicon/manganese killed steel and the oxide inclusions may comprise any one or more of MnO, $SiO_2$ and $Al_2O_3$ inclusions. The inclusions typically may range in size between 2 and 12 microns, so that at least a majority of the inclusions are in that size range.

The method described above produces a unique steel high in oxygen content distributed in oxide inclusions. Specifically, the combination of the high oxygen content in the molten steel and the short residence time of the molten steel in the casting pool results in a thin steel strip with improved ductility properties.

BRIEF DESCRIPTION OF THE DRAWINGS

In order that the invention may be described in more detail, some illustrative examples will be given with reference to the accompanying drawings in which.

DETAILED DESCRIPTION OF THE DRAWINGS

Figure 1:
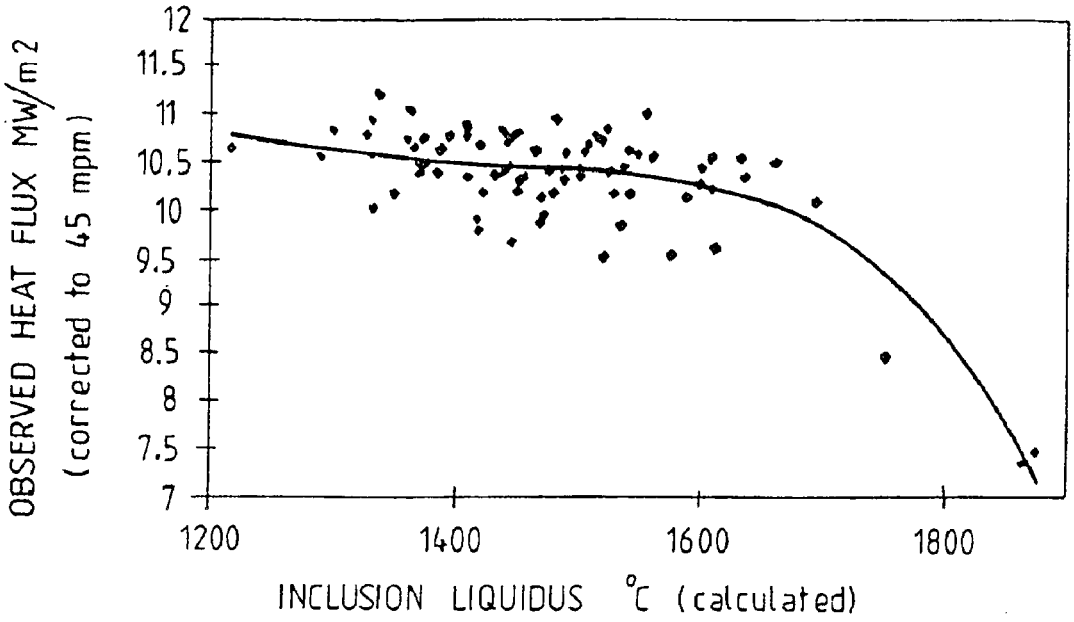
FIG. 1 shows the effect of inclusion melting points on heat fluxes obtained in twin roll casting trials using silicon/manganese killed steels.

While the invention will be illustrated and described in detail in the drawings and following description, the same is to be considered as illustrative and not restrictive in character, it being understood that one skilled in the art will recognize, and that it is desired to protect, all aspects, changes and modifications that come within the concept of the invention.

We have conducted extensive casting trials on a twin roll caster of the kind fully described in U.S. Pat. Nos. 5,184,668 and 5,277,243 to produce steel strip of the order of 1 mm thick and less. Such casting trials using silicon manganese killed steel have demonstrated that the melting point of oxide inclusions in the molten steel have an effect on the heat fluxes obtained during steel solidification as illustrated in FIG. 1. Low melting point oxides improve the heat transfer contact between the molten metal and the casting roll surfaces in the upper regions of the pool, generating higher heat transfer rates.

Liquid inclusions are not produced when their melting points are higher than the steel temperature in the casting pool. Therefore, there is a dramatic reduction in heat transfer rate when the inclusion melting point is greater than approximately 1600° C. With casting trials, we found that with aluminum killed steels, the formation of high melting point alumina inclusions (melting point 2050° C.) could be limited if not avoided by, calcium additions to the composition to provide liquid $CaO.Al_2O_3$ inclusions.

The solidification oxide inclusions formed in the solidified metal shells. Therefore, the thin steel strip comprises inclusions formed during cooling and solidification of the steel, as well as deoxidation inclusions formed during refining in the ladle.

The free oxygen level in the steel is reduced dramatically during cooling at the meniscus, resulting in the generation of solidification inclusions near the surface of the strip. These solidification inclusions are formed predominantly of MnO. $SiO_2$ by the following reaction:

$$Mn+Si+3\underline{O}=MnO\ SiO_2$$

Figure 2:
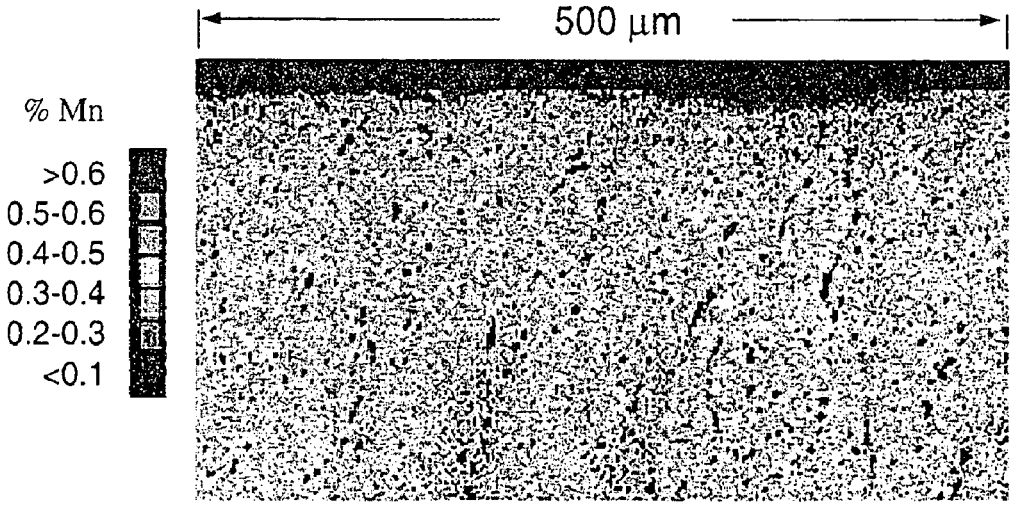
FIG. 2 is an energy dispersive spectroscopy (EDS) map of Mn showing a band of fine solidification inclusions in a solidified steel strip.
Figure 3:
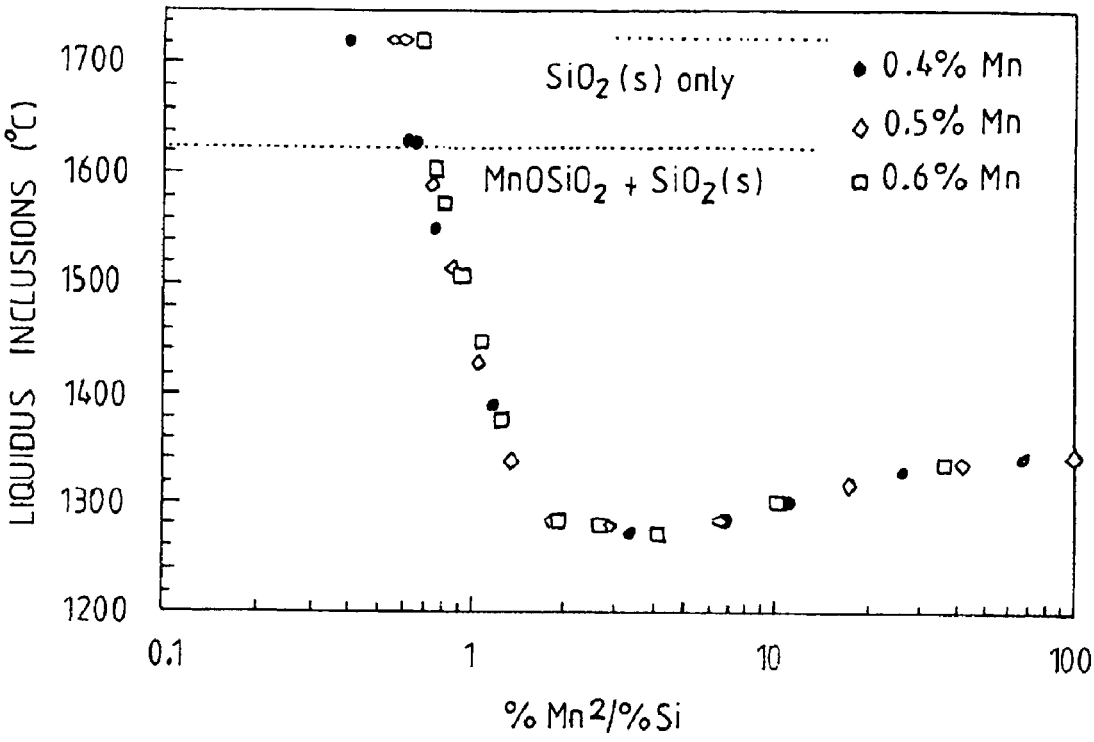
FIG. 3 is a plot showing the effect of varying manganese to silicon contents on the liquidus temperature of inclusions.

The appearance of the solidification inclusions on the strip surface, obtained from an Energy Dispersive Spectroscopy (EDS) map, is shown in FIG. 2. It can be seen that solidification inclusions are extremely fine (typically less than 2 to 3 μm) and are located in a band located within 10 to 20 μm from the surface. A typical size distribution of the oxide inclusions through the strip is shown in FIG. 3 of our paper entitled Recent Developments in Project M the Joint Development of Low Carbon Steel Strip Casting by BHP and IHI, presented at the METEC Congress 99, Dusseldorf Germany (Jun. 13-15, 1999).

In manganese silicon killed steel, the comparative levels of the solidification inclusions are primarily determined by the Mn and Si levels in the steel. FIG. 3 shows that the ratio of Mn to Si has a significant effect on the liquidus temperature of the inclusions. A manganese silicon killed steel having a carbon content in the range of 0.001% to 0.1% by weight, a manganese content in the range 0.1% to 2.0% by weight and a silicon content in the range 0.1% to 10% by weight and an aluminum content of the order of 0.01% or less by weight can produce such solidification oxide inclusions during cooling of the steel in the upper regions of the casting pool. In particular the steel may have the following composition, termed M06:

| | |
|---|---|
| Carbon | 0.06% by weight |
| Manganese | 0.6% by weight |
| Silicon | 0.28% by weight |
| Aluminium | 0.002% by weight. |

Deoxidation inclusions are generally generated during deoxidation of the molten steel in the ladle with Al, Si and Mn. Thus, the composition of the oxide inclusions formed during deoxidation is mainly $MnO.SiO_2.Al_2O_3$ based. These deoxidation inclusions are randomly located in the strip and are coarser than the solidification inclusions near the strip surface formed by reaction of the free oxygen during casting.

Figure 4:
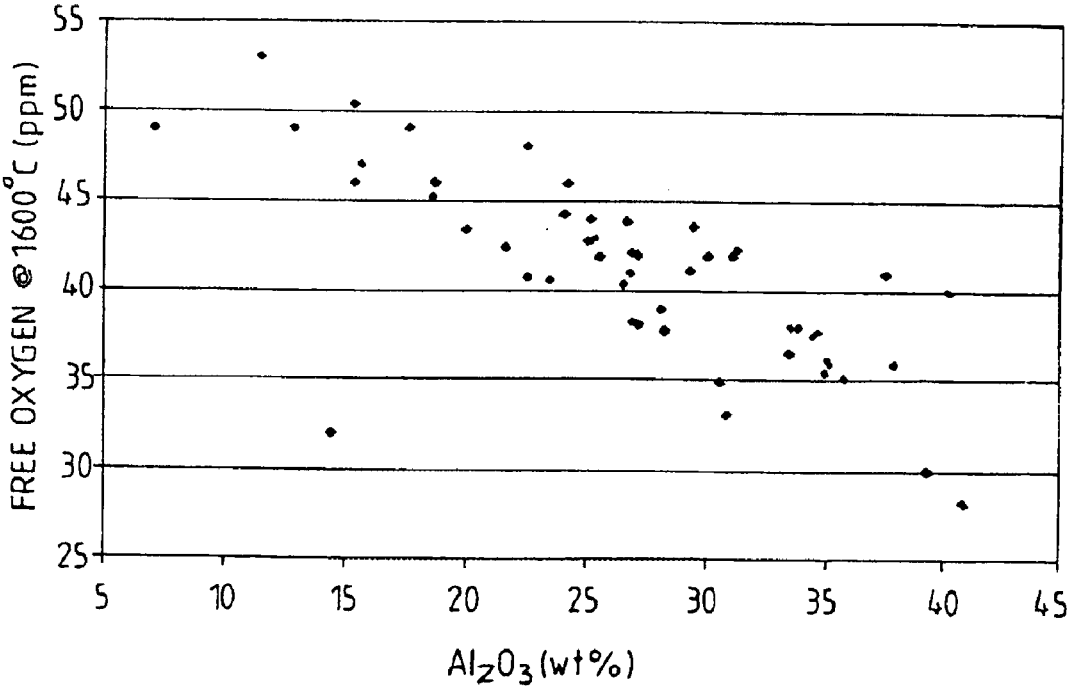
FIG. 4 shows the relationship between alumina content (measured from the strip inclusions) and deoxidation effectiveness.

The alumina content of the inclusions has a strong effect on the free oxygen level in the steel and can be used to control the free oxygen levels in the melt. FIG. 4 shows that with increasing alumina content, the free oxygen levels in the steel is reduced. The free oxygen reported in FIG. 4 was measured using the Celox® measurement system made by Heraeus Electro-Nite, and the measurements normalized to 1600° C. to standardize reporting of the free oxygen content as in the following claims.

With the introduction of alumina, $MnO/SiO_2$ inclusions are diluted with a subsequent reduction in their activity, which in turn reduces the free oxygen level, as seen from the following reaction:

$$\underline{Mn}+\underline{Si}+3\underline{O}+Al_2O_3 \Leftrightarrow (Al_2O_3).MnO.SiO_2.$$

Figure 5:
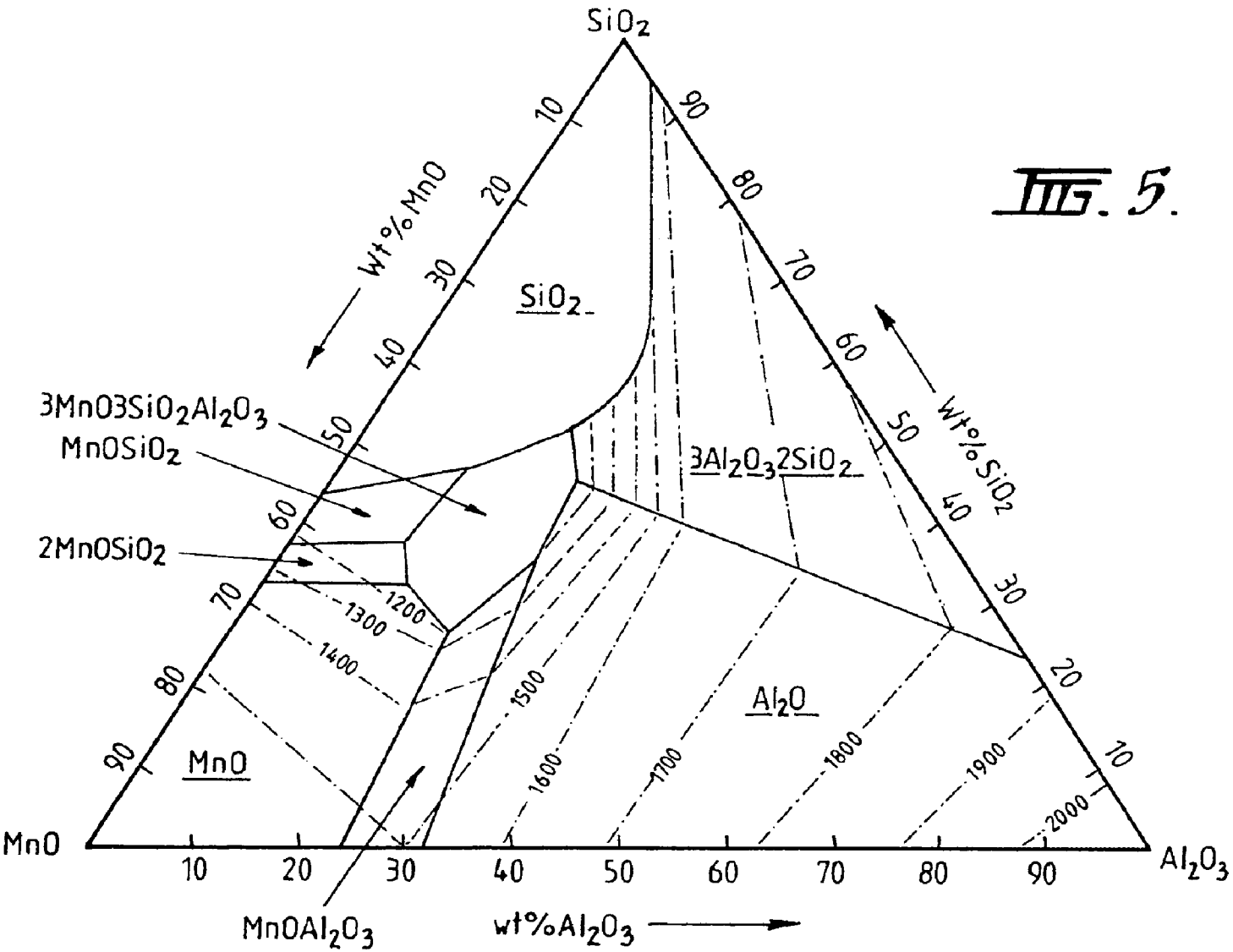
FIG. 5 is a ternary phase diagram for $MnO.SiO_2.Al_2O_3$.

For $MnO.SiO_2.Al_2O_3$ based inclusions, the effect of inclusion composition on liquidus temperature can be obtained from the ternary phase diagram shown in FIG. 5.

Figure 6:
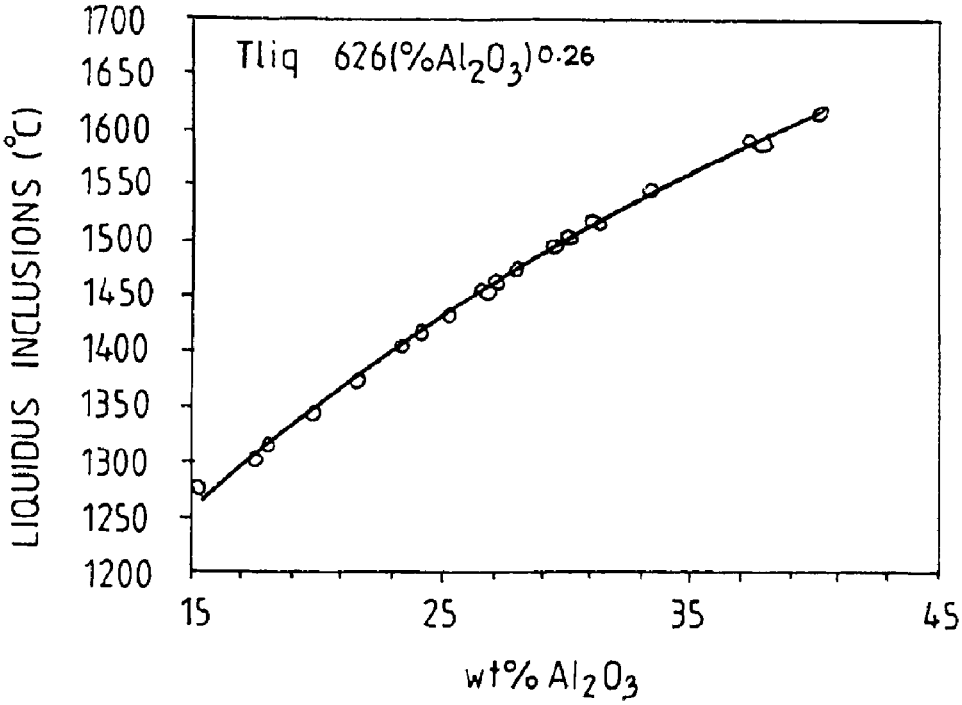
FIG. 6 shows the relationship between alumina content inclusions and liquidus temperature.

Analysis of the oxide inclusions in the thin steel strip has shown that the $MnO/SiO_2$ ratio is typically within 0.6 to 0.8 and for this regime, it was found that alumina content of the oxide inclusions had the strongest effect on the melting point (liquidus temperature) of the inclusions, as shown in FIG. 6.

With initial trial work, we determined that it is important for casting in accordance with the present invention to have the solidification and deoxidation inclusions such that they are liquid at the initial solidification temperature of the steel and that the molten steel in the casting pool have an oxygen content of at least 100 ppm and free oxygen levels between 30 and 50 ppm to produce metal shells. The levels of oxide inclusions produced by the total oxygen and free oxygen contents of the molten steel promote nucleation and high heat flux during the initial and continued solidification of the steel on the casting roll surfaces. Both solidification and deoxidation inclusions are oxide inclusions and provide nucleation sites and contribute significantly to nucleation during the metal solidification process, but the deoxidation inclusions may be rate controlling in that their concentration can be varied and their concentration affects the concentration of free oxygen present. The deoxidation inclusions are much bigger, typically greater than 4 microns, whereas the solidification inclusions are generally less than 2 microns and are $MnO.SiO_2$ based, and have no $Al_2O_3$ whereas the deoxidation inclusions also have $Al_2O_3$ present as part of the inclusions.

It was found in casting trials using the above M06 grade of silicon/manganese killed steel that if the total oxygen content of the steel was reduced in the ladle refining process to low levels of less than 100 ppm, heat fluxes are reduced and casting is impaired whereas good casting results can be achieved if the total oxygen content is at least above 100 ppm and typically on the order of 200 ppm. As described in more detail below, these oxygen levels in the ladle result in total oxygen levels of at least 70 ppm and free oxygen levels between 20 and 60 ppm in the tundish, and in turn the same or slightly lower oxygen levels in the casting pool. The total oxygen content may be measured by a "Leco" instrument and is controlled by the degree of "rinsing" during ladle treatment, i.e., the amount of argon bubbled through the ladle via a porous plug or top lance, and the duration of the treatment. The total oxygen content was measured by conventional procedures using the LECO TC-436 Nitrogen/Oxygen Determinator described in the TC 436 Nitrogen/Oxygen Determinator Instructional Manual available from LECO (Form No. 200-403, Rev. April 96, Section 7 at pp. 7-1 to 7-4.)

In order to determine whether the enhanced heat fluxes obtained with higher total oxygen contents was due to the availability of oxide inclusions as nucleation sites during casting, casting trials were carried out with steels in which deoxidation in the ladle was carried out with calcium silicide (Ca—Si) and the results compared with casting with the low carbon Si-killed steel known as M06 grades of steel.

The results are set out in the following tables:

TABLE 1

Heat flux differences between M06 and Ca—Si grades.

| Cast No. | Grade | Casting speed, (m/min) | Pool Height, (mm) | Total heat Removed (MW) |
|---|---|---|---|---|
| M 33 | M06 | 64 | 171 | 3.55 |
| M 34 | M06 | 62 | 169 | 3.58 |
| O 50 | Ca—Si | 60 | 176 | 2.54 |
| O 51 | Ca—Si | 66 | 175 | 2.56 |

Although Mn and Si levels were similar to normal Si-killed grades, the free oxygen level in Ca—Si heats was lower and the oxide inclusions contained more CaO. Heat fluxes in Ca—Si heats were therefore lower despite a lower inclusion melting point (See Table 2).

TABLE 2

| Slag compositions with Ca—Si deoxidation | | | | | | |
|---|---|---|---|---|---|---|
| | Free Oxygen | Slag Composition (wt %) | | | | Inclusion melting temperature |
| Grade | (ppm) | $SiO_2$ | MnO | $Al_2O_3$ | CaO | (° C.) |
| Ca—Si | 23 | 32.5 | 9.8 | 32.1 | 22.1 | 1399 |

Figure 7:
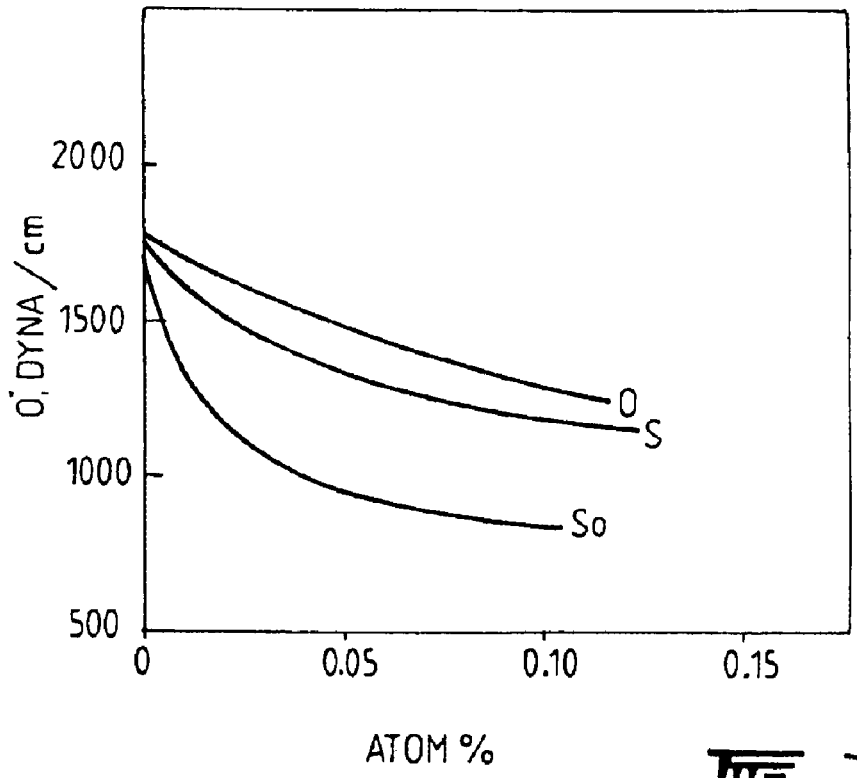
FIG. 7 shows the effect of oxygen in a molten steel on surface tension.

The free oxygen levels in Ca—Si grades were lower, typically 20 to 30 ppm compared to 40 to 50 ppm with M06 grades. Oxygen is a surface active element and thus reduction in free oxygen level is expected to reduce the wetting between molten steel and the casting rolls and cause a reduction in the heat transfer rate between the metal and the casting rolls. However, from FIG. 7 it appears that free oxygen reduction from 40 to 20 ppm may not be sufficient to increase the surface tension to levels that explain the observed reduction in the heat flux.

It can be concluded that lowering the free and total oxygen levels in the steel reduces the volume of inclusions and thus reduces the number of oxide inclusions for initial nucleation and continued formation of solidification inclusions during casting. This has the potential to adversely impact the nature of the initial and continued intimate contact between steel shells and the roll surface. Dip testing work has shown that a nucleation per unit area density of about 120/mm$^2$ is required to generate sufficient heat flux on initial solidification in the upper meniscus region of the casting pool. Dip testing involves advancing a chilled block into a bath of molten steel at such a speed as to closely simulate the conditions of contact at the casting surfaces of a twin roll caster. Steel solidifies onto the chilled block as it moves through the molten bath to produce a layer of solidified steel on the surface of the block. The thickness of this layer can be measured at points throughout its area to map variations in the solidification rate and in turn the effective rate of heat transfer at the various locations. It is thus possible to produce an overall solidification rate as well as total heat flux measurements. It is also possible to examine the microstructure of the strip surface to correlate changes in the solidification microstructure with the changes in observed solidification rates and heat transfer values, and to examine the structures associated with nucleation on initial solidification at the chilled surface. A dip testing apparatus is more fully described in U.S. Pat. No. 5,720,336.

The relationship of the oxygen content of the liquid steel on initial nucleation and heat transfer has been examined using a model described in Appendix 1. This model assumes that all the oxide inclusions are spherical and are uniformly distributed throughout the steel. A surface layer was assumed to be 2 μm and it was assumed that only inclusions present in that surface layer could participate in the nucleation process on initial solidification of the steel. The input to the model was total oxygen content in the steel, inclusion diameter, strip thickness, casting speed, and surface layer thickness. The output was the percentage of inclusions of the total oxygen in the steel required to meet a targeted nucleation per unit area density of 120/mm$^2$.

Figure 8:
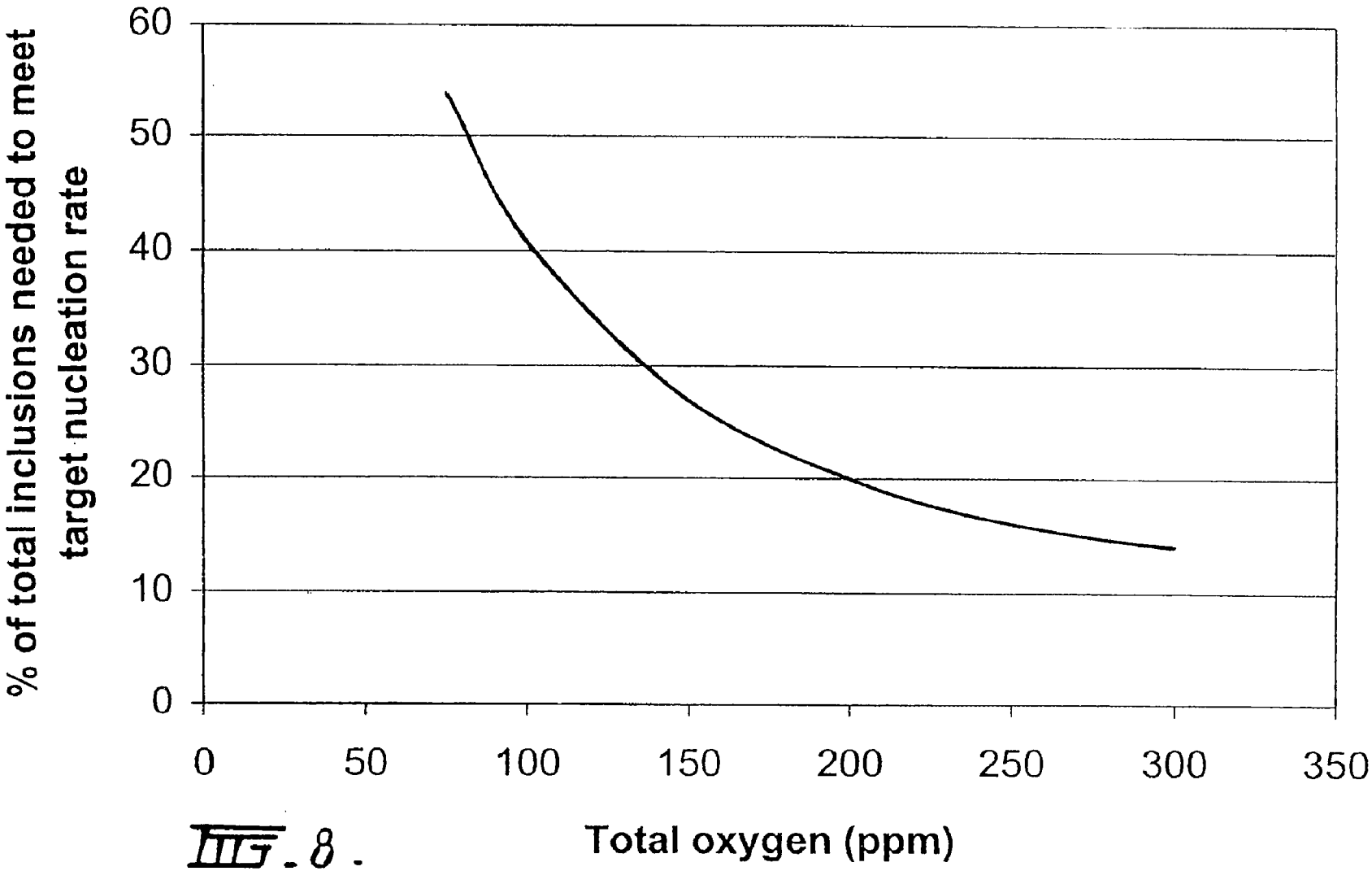
FIG. 8 is a plot of the results of calculations concerning the inclusions available for nucleation at differing steel cleanliness levels.

FIG. 8 is a plot of the percentage of oxide inclusions in the surface layer required to participate in the nucleation process to achieve the target nucleation per unit area density at different steel cleanliness levels as expressed by total oxygen content, assuming a strip thickness of 1.6 mm and a casting speed of 80 m/min. This shows that for a 2 μm inclusion size and 200 ppm total oxygen content, 20% of the total available oxide inclusions in the surface layer are required to achieve the target nucleation per unit area density of 120/mm$^2$. However, at 80 ppm total oxygen content, around 50% of the inclusions are required to achieve the critical nucleation rate and at 40 ppm total oxygen level there will be an insufficient level of oxide inclusions to meet the target nucleation per unit area density. Accordingly when trimming the steel by deoxidation in the ladle, the oxygen content of the steel can be controlled to produce a total oxygen content in the range 100 to 250 ppm and typically about 200 ppm. This will have the result that the two micron deep layers adjacent the casting rolls on initial solidification will contain oxide inclusions having a per unit area density of at least 120/mm$^2$. These inclusions will be present in the outer surface layers of the final solidified strip product and can be detected by appropriate examination, for example by energy dispersive spectroscopy (EDS).

Following the casting trials, more extensive production has commenced of which the total oxygen and free oxygen levels are reported in FIGS. 9 through 18. We found that the total oxygen content of the molten steel had to be maintained above about 70 ppm and that the free oxygen content could be between 20 and 60 ppm. This is reported in FIGS. 9 through 18 for sequence runs done between Aug. 3, 2003 and Oct. 2, 2003.

Figure 9:
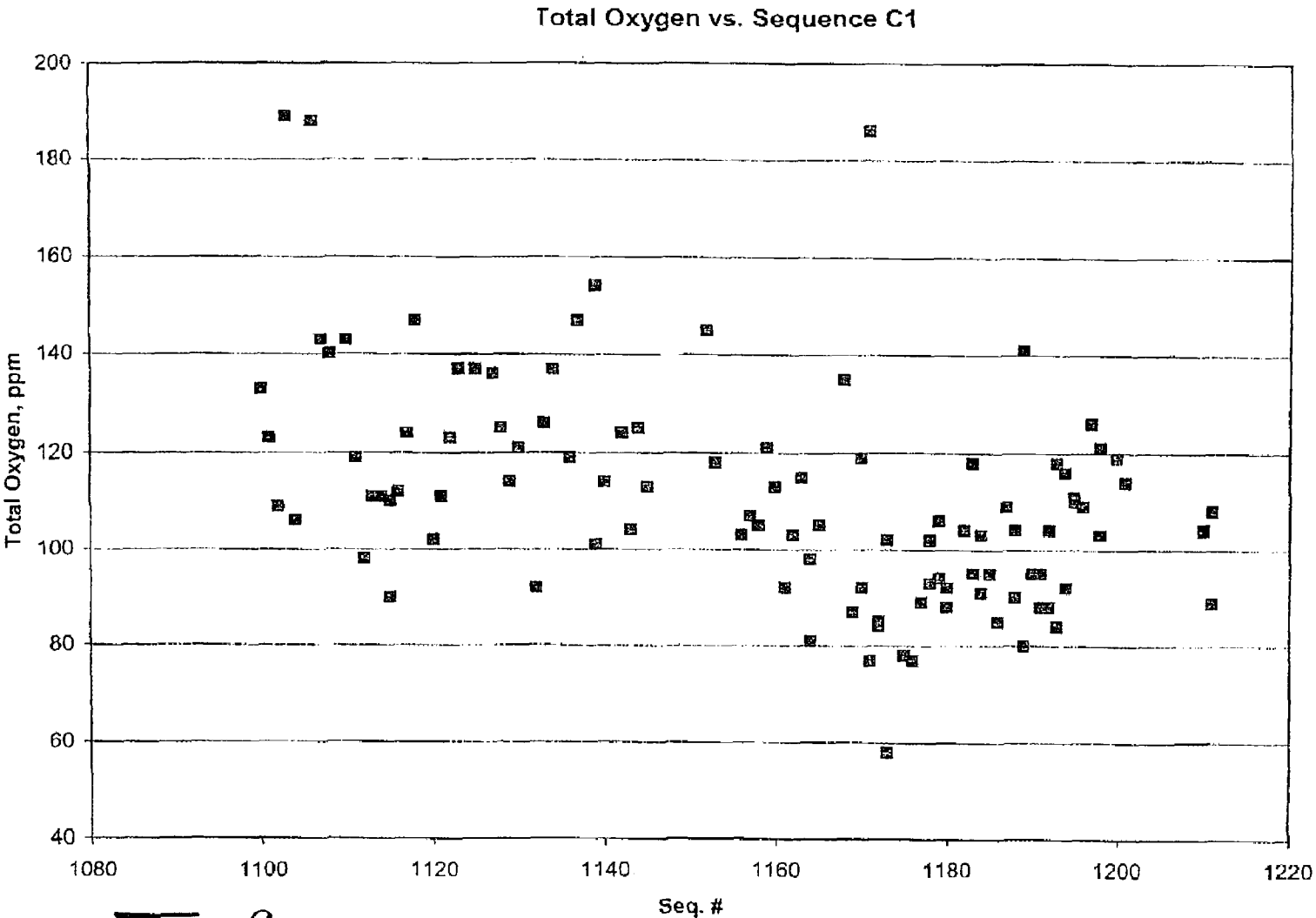
FIGS. 9-13 are plots showing the total oxygen content of production steel melts in the tundish immediately above the casting pool of molten steel during casting of thin strip with a twin-roll caster.
Figure 10:
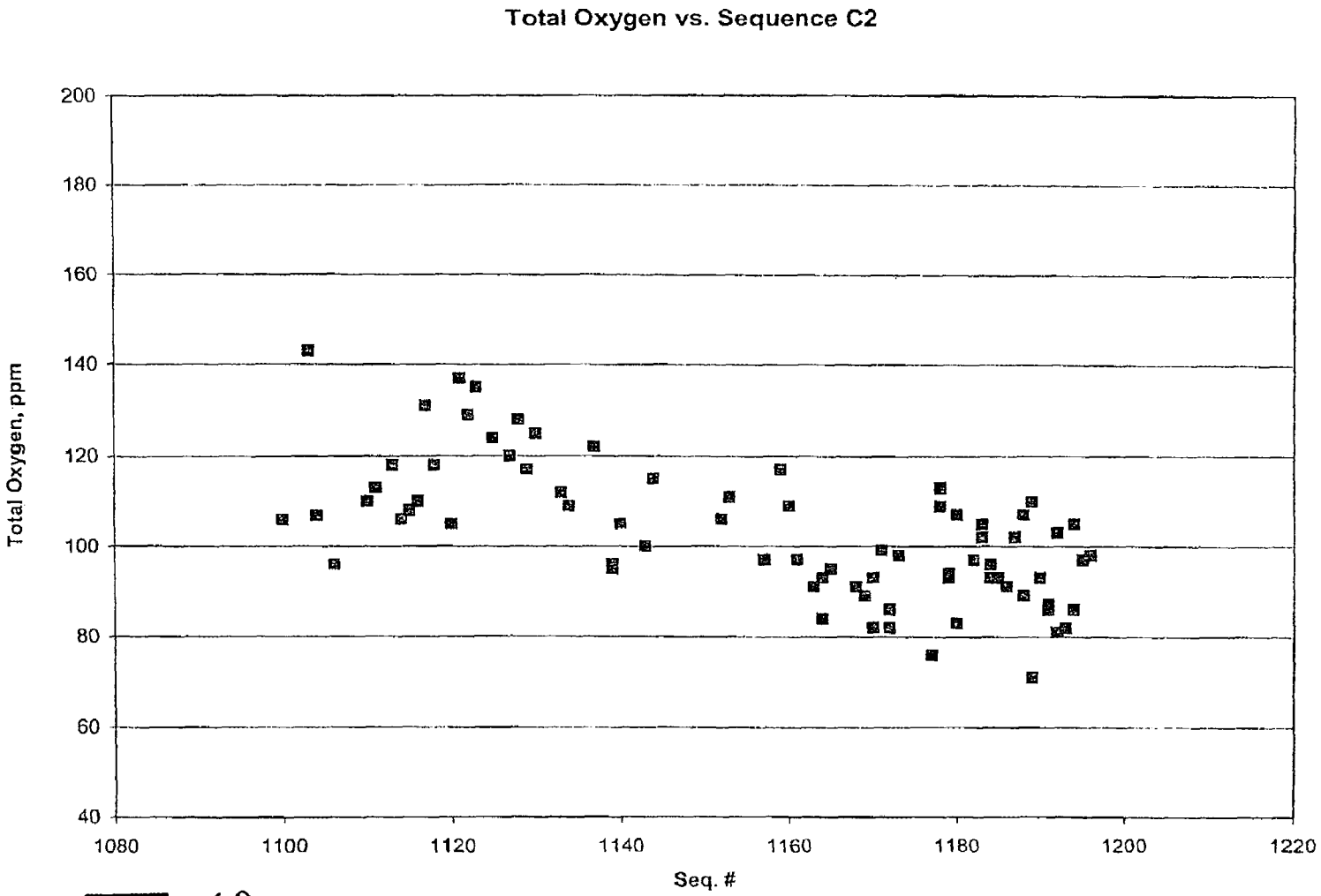
Figure 11:
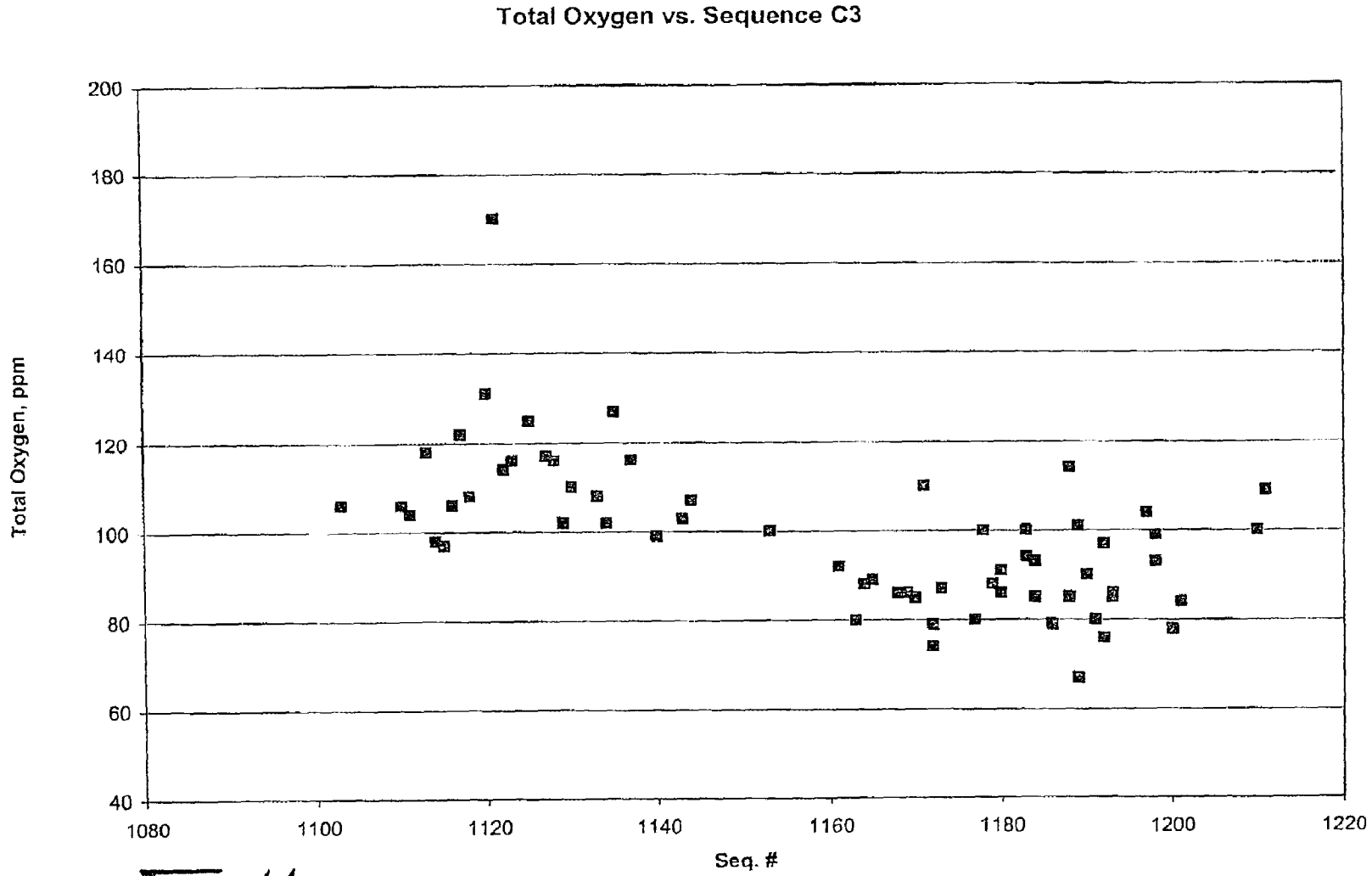
Figure 12:
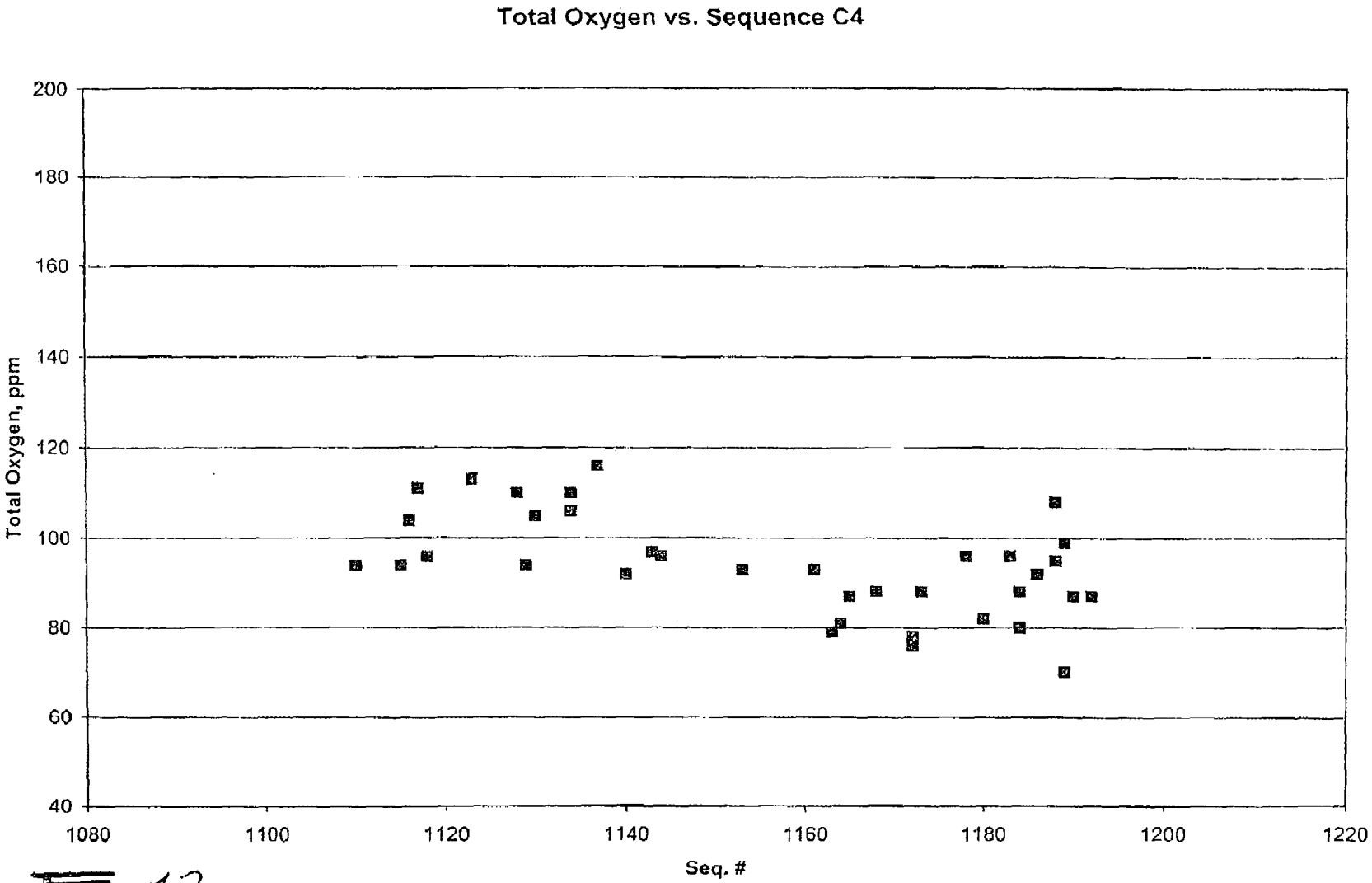
Figure 13:
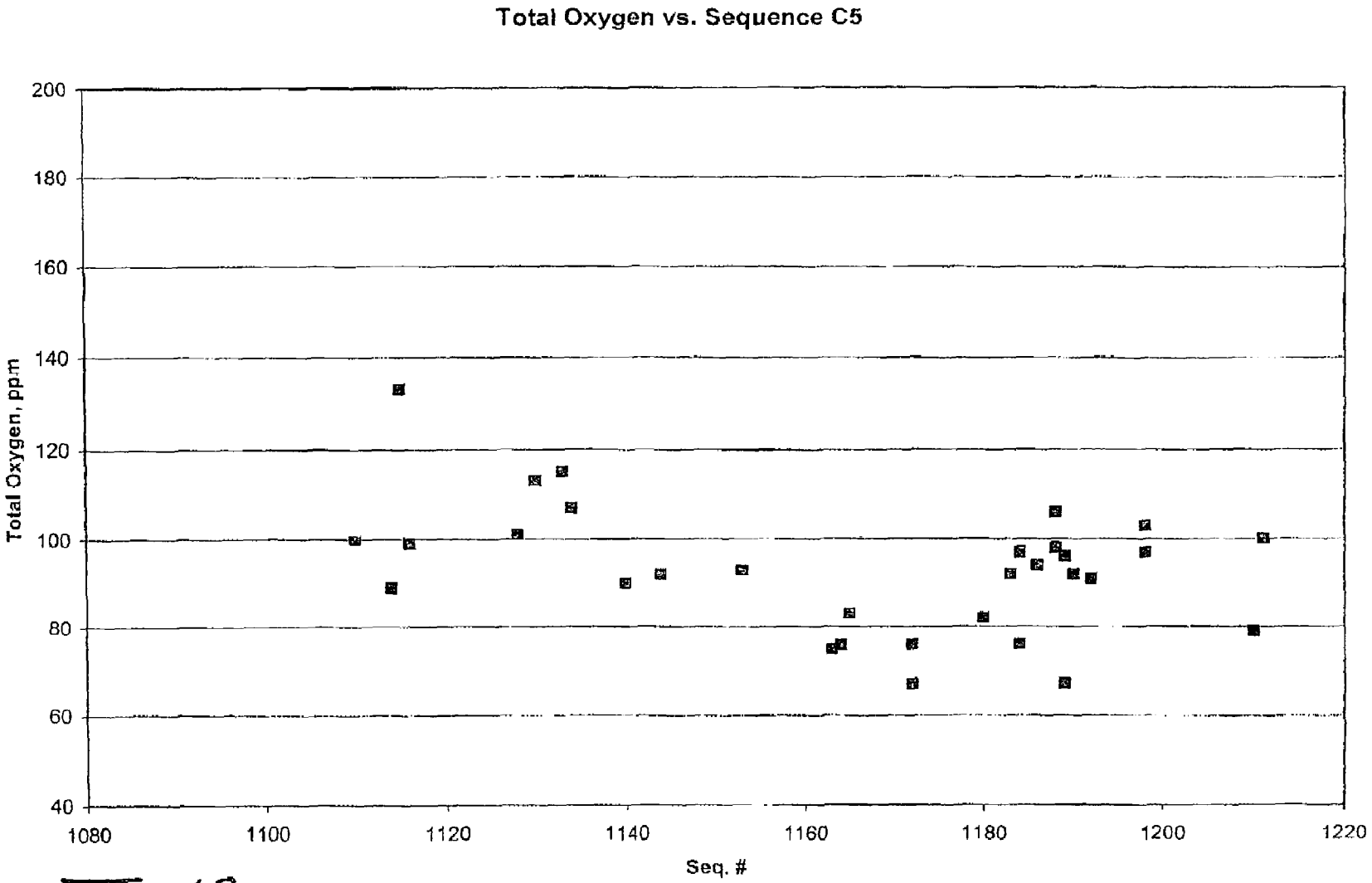
Figure 14:
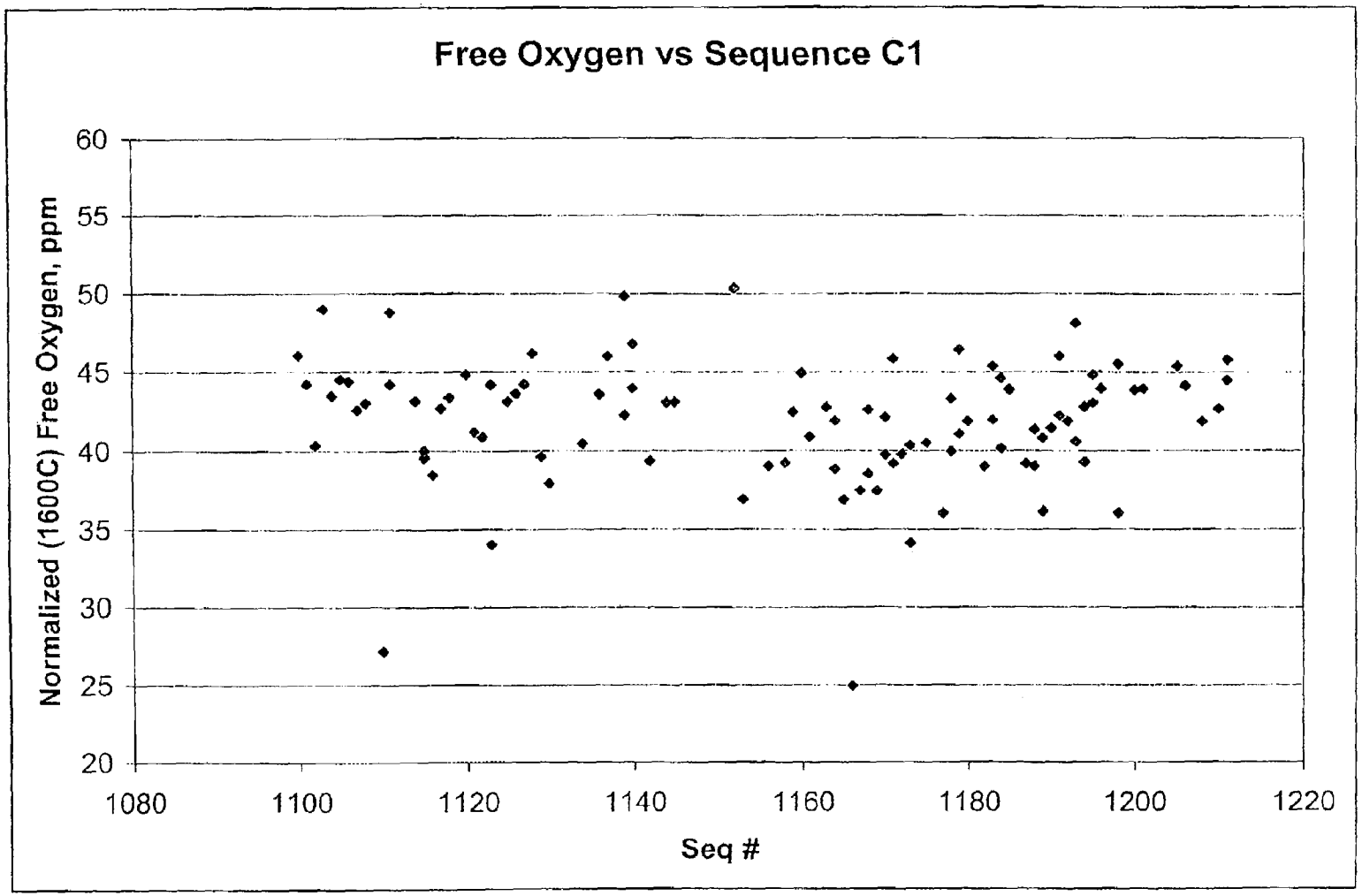
FIGS. 14-18 are plots of the free oxygen content of the same productions steel melts reported in FIGS. 9-13 in the tundish immediately above the casting pool of molten steel during casting of thin strip with a twin-roll caster.
Figure 15:
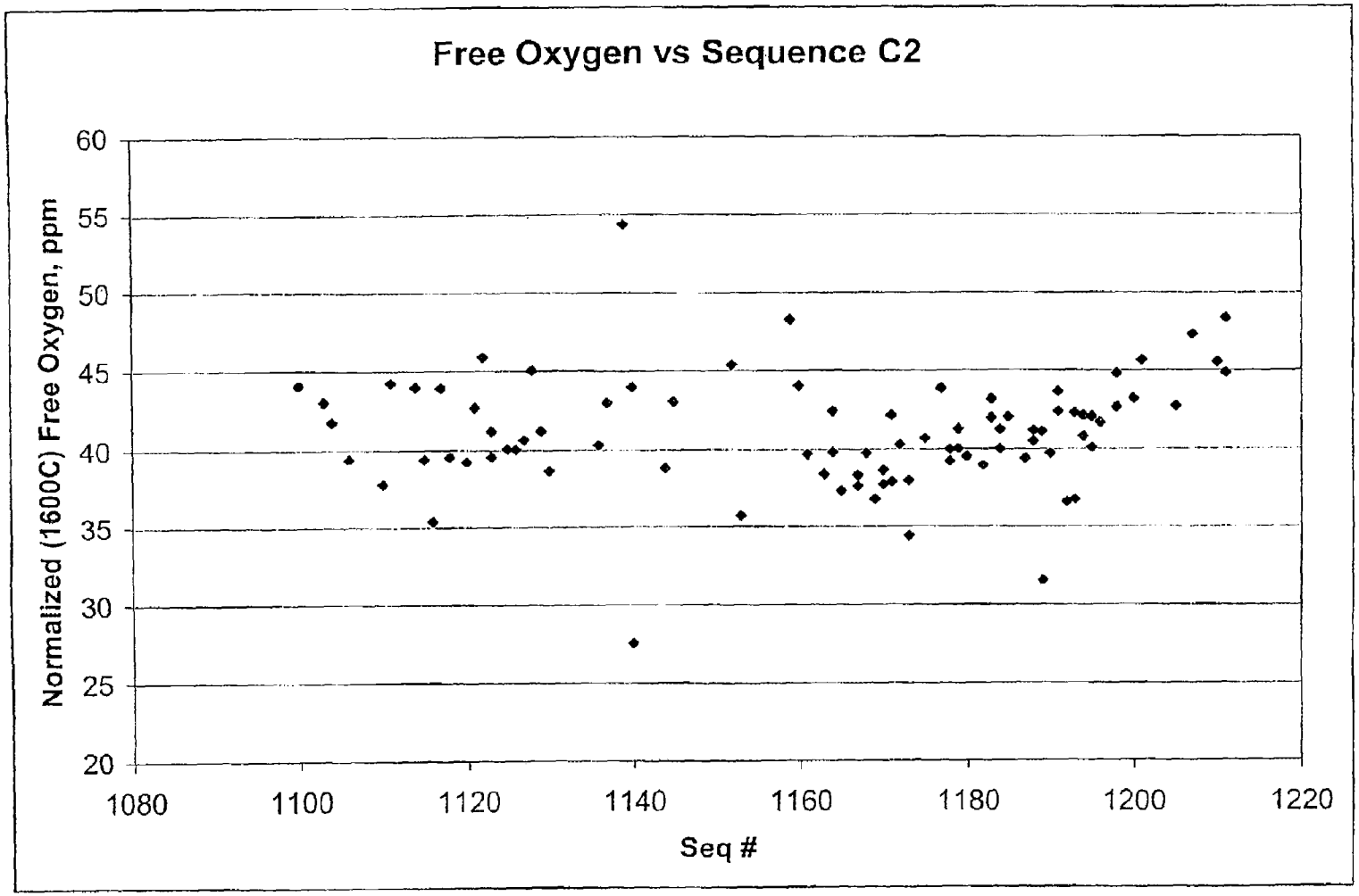
Figure 16:
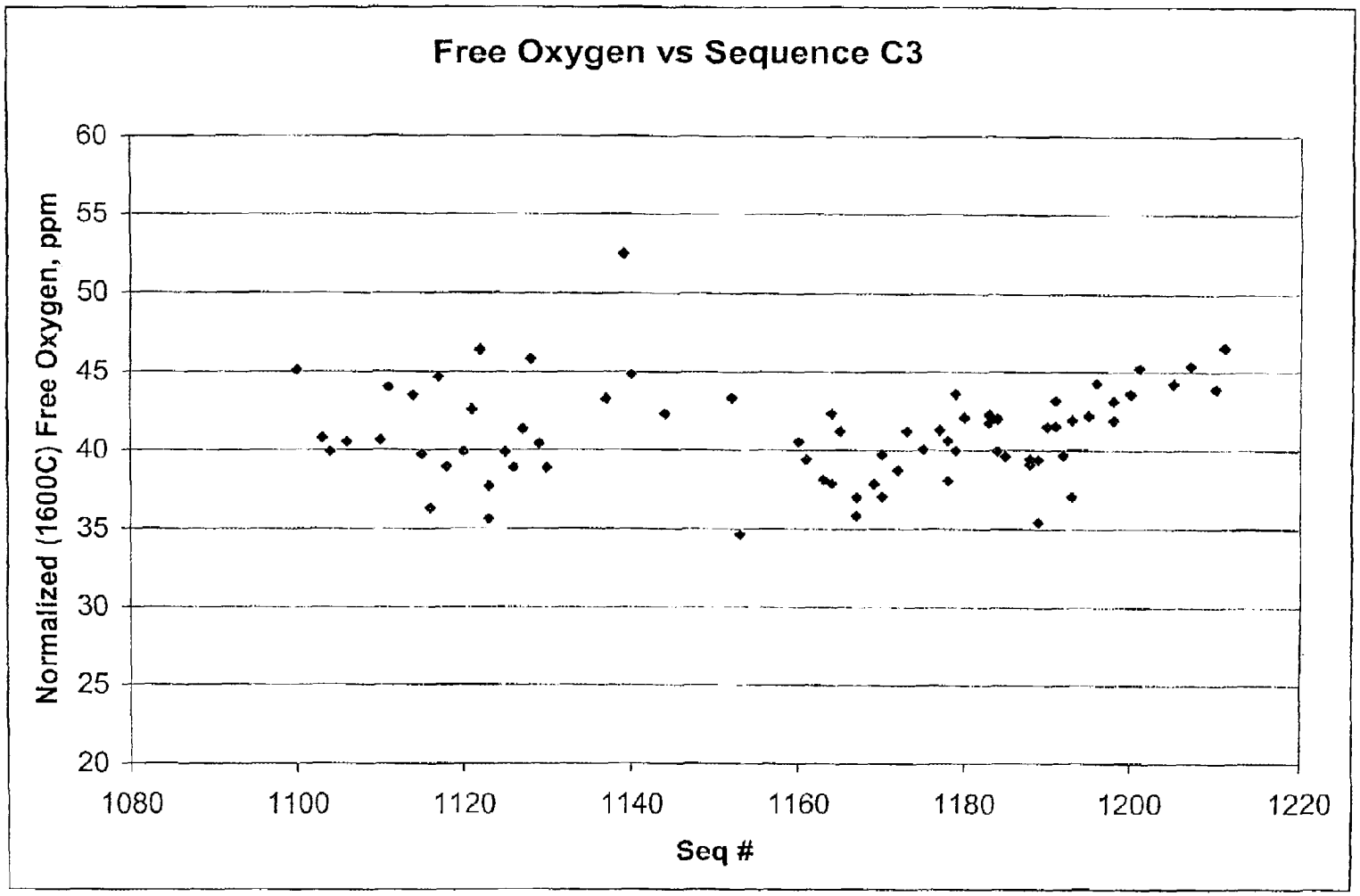
Figure 17:
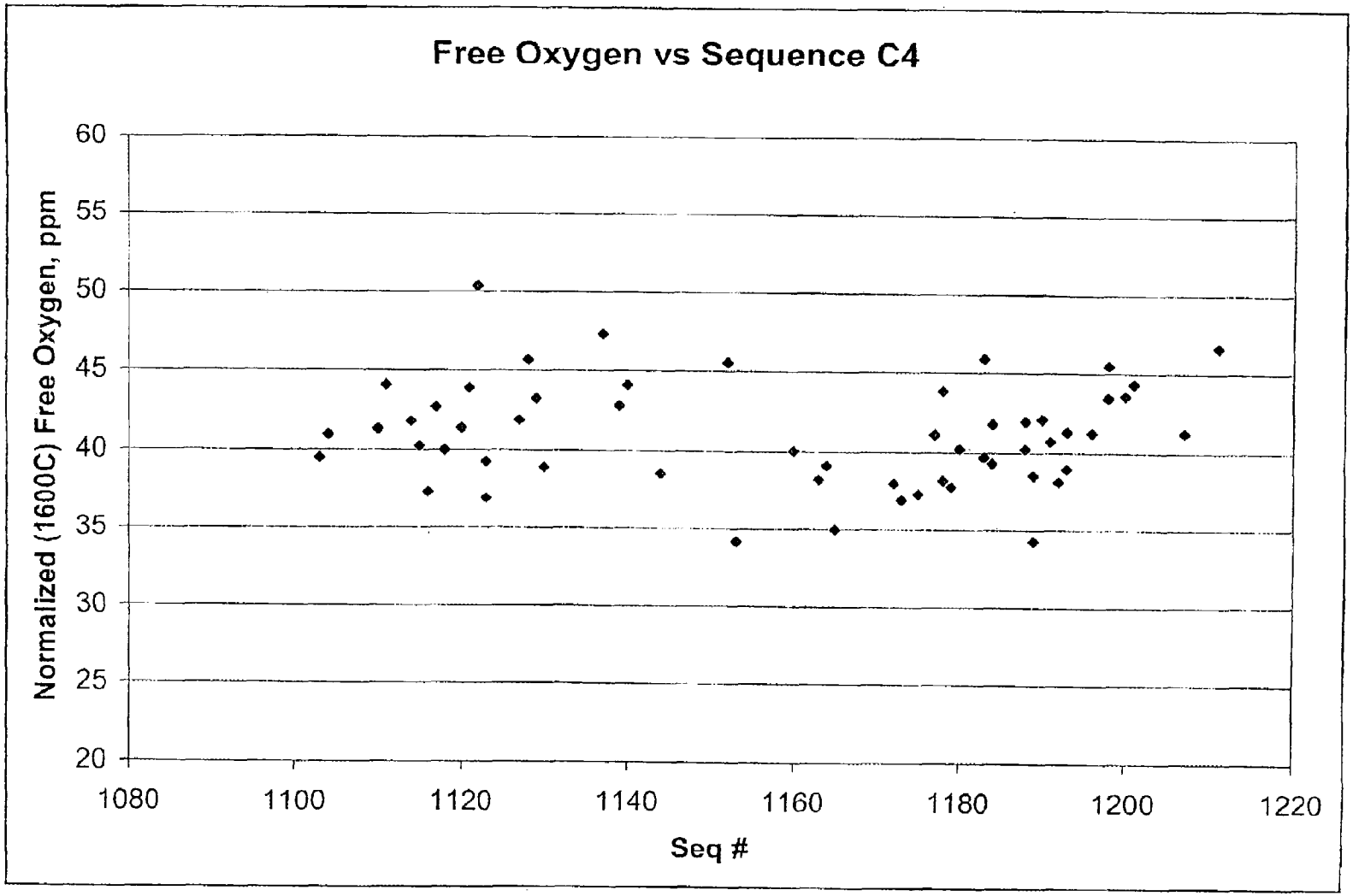
Figure 18:
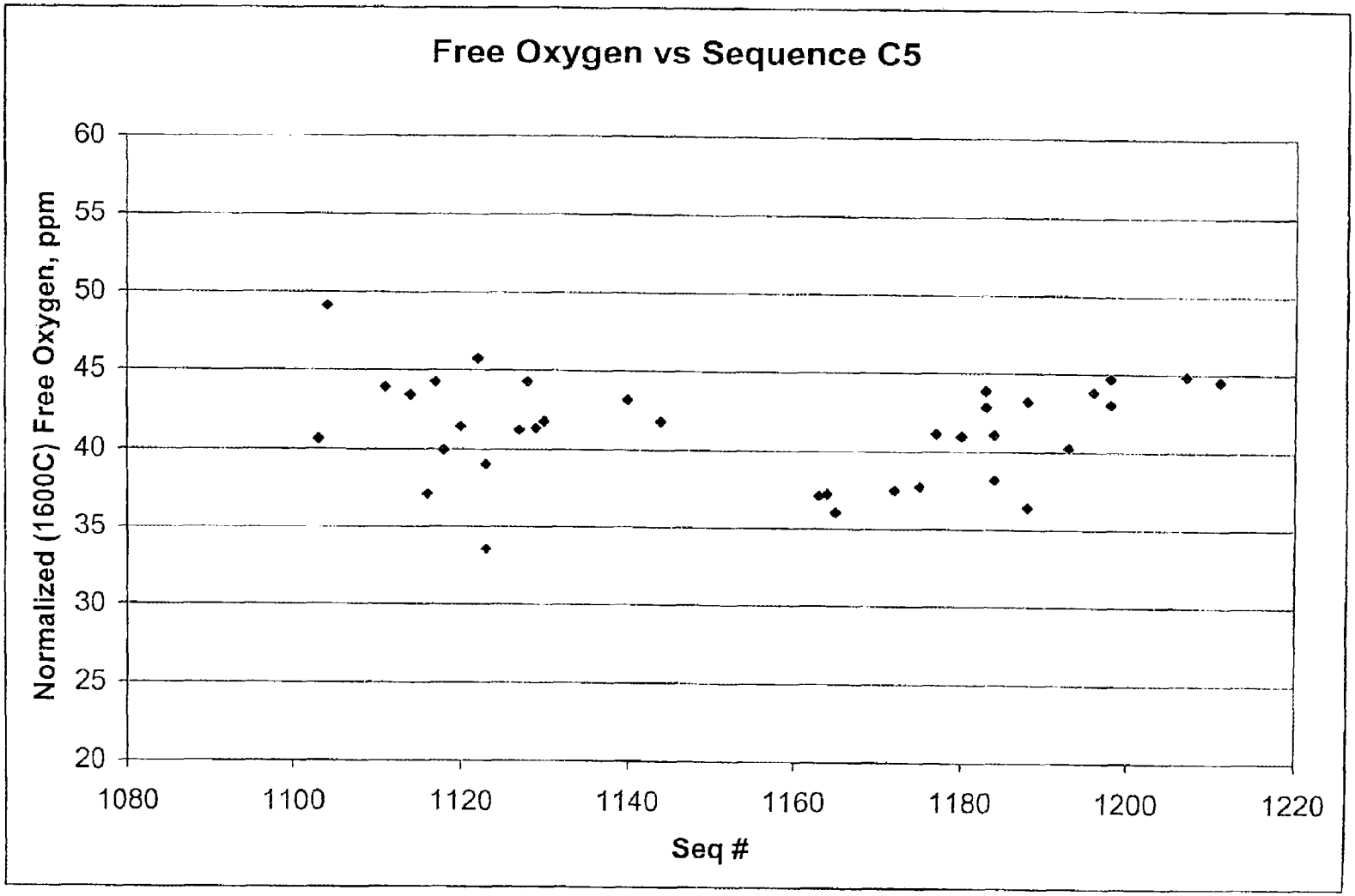

The measurements reported in FIGS. 9 and 14 where the first sample taken of total oxygen and free oxygen levels in the tundish immediately above the casting pool. Again the total oxygen content was measured by the Leco instrument as described above, and the free oxygen content measured by the Celox system described above. The free oxygen levels reported are the actual measured values normalized values to 1600° C., to standardize measurement of free oxygen in accordance with the present invention as described in the claims.

These free oxygen and total oxygen levels were measured in the tundish immediately above the casting pool, and although the temperature of the steel in the tundish is higher than in the casting pool, these levels are indicative of the slightly lower total oxygen and free oxygen levels of the molten steel in the casting pool. The measured values of total oxygen and free oxygen from the first samples are reported in FIGS. 9 and 14, taken during filling of the casting pool or immediately following filling of the casting pool at the start of the campaigns. It is understood that the total oxygen and free oxygen levels will reduce during the campaign. FIGS. 10-13 and 15-18 show the measurements of total oxygen and free oxygen in the tundish immediately above the casting pool with samples 2, 3, 4 and 5 taken during the campaign to illustrate the reduction.

Also, these data show the practice of the invention with high blow (120-180 ppm), low blow (70-90 ppm) and ultra low blow (60-70 ppm) with the oxygen lance in the LMF. Sequence nos. from 1090 to 1130 were done with high blow practice, sequences nos. from 1130 to 1160 were done with low blow practice, and sequence nos. from 1160 to 1220 were done with ultra low blow practice. These data show that total oxygen levels reduced with the lower the blow practices, but that free oxygen levels did not reduce as much. These data show that the best procedure is to blow with ultra low blow practice to conserve oxygen used while providing adequate total oxygen and free oxygen levels to practice the present invention.

As can be seen from these data, the total oxygen is at least about 70 ppm (except for one outlier) and typically below 200 ppm, with the total oxygen level generally between about 80 ppm and 150 ppm. The free oxygen levels were above 25 ppm and generally clustered between about 30 and about 50 ppm, which means the free oxygen content should be between 20 and 60 ppm. Higher levels of free oxygen will cause the oxygen to combine in formation of unwanted slag, and lower levels of free oxygen will result in insufficient formation of solidification inclusions for efficient shell formation and strip casting.

EXAMPLE

| | | |
|---|---|---|
| | INPUTS | |
| Critical nucleation per unit area density no/mm$^2$ (needed to achieve sufficient heat transfer rates) | 120 | This value has been obtained from experimental dip testing work |
| Roll width, m | 1 | |
| Strip thickness, mm | 1.6 | |
| Ladle tonnes, t | 120 | |
| Steel density, kg/m$^3$ | 7800 | |
| Total oxygen, ppm | 75 | |
| Inclusion density, kg/m$^3$ | 3000 | |
| | OUTPUTS | |
| Mass of inclusions, kg | 21.42857 | |
| Inclusion diameter, m | 2.00E−06 | |
| Inclusion volume, m$^3$ | 0.0 | |
| Total no of inclusions | 1706096451319381.5 | |
| Thickness of surface layer, μm (one side) | 2 | |
| Total no of inclusions surface only | 4265241128298.4536 | These inclusions can participate in the initial nucleation process |
| Casting speed, m/min | 80 | |
| Strip length, m | 9615.38462 | |
| Strip surface area, m$^2$ | 19230.76923 | |
| Total no of nucleating sites required | 2307692.30760 | |
| % of available inclusions that need to participate in the nucleation process | 54.10462 | |

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

APPENDIX 1 a. List of symbols w=roll width, m t=strip thickness, mm $m_s$=steel weight in the ladle, tonne $\rho_s$=density of steel, kg/m$^3$ $\rho_i$=density of inclusions, kg/m$^3$ $O_t$=total oxygen in steel, ppm d=inclusion diameter, m $v_i$=volume of one inclusions, m3

$m_i$=mass of inclusions, kg $N_t$=total number of inclusions $t_s$=thickness of the surface layer, μm $N_s$=total number of inclusions present in the surface (that can participate in the nucleation process)

u=casting speed, m/min $L_s$=strip length, m $A_s$=strip surface area, m$^2$ $N_{req}$=Total number of inclusions required to meet the target nucleation density $NC_t$=target nucleation per unit area density, number/mm$^2$ (obtained from dip testing)

$N_{av}$=% of total inclusions available in the molten steel at the surface of the casting rolls for initial nucleation process.

b. Equations $$m_i=(O_t \times m_s \times 0.001)/0.42 \quad (1)$$

Note: for Mn—Si killed steel, 0.42 kg of oxygen is needed to produce 1 kg of inclusions with a composition of 30% MnO, 40% $SiO_2$ and 30% $Al_2O_3$.

For Al-killed steel (with Ca injection), 0.38 kg of oxygen is required to produce 1 kg of inclusions with a composition of 50% $Al_2O_3$ and 50% CaO.

$$v_i=4.19\times(d/2)^3 \quad (2)$$

$$N_t=m_i(\rho_i \times v_i) \quad (3)$$

$$N_s=(2.0\ t_s \times 0.001 \times N_t/t) \quad (4)$$

$$L_s=(m_s \times 1000)/(\rho_s \times w \times t/1000) \quad (5)$$

$$A_s=2.0\times L_s \times w \quad (6)$$

$$N_{req}=A_s \times 10^6 \times NC_t \quad (7)$$

$$N_{av}\%=(N_{req}/N_s)\times 100.0 \quad (8)$$

Eq. 1 calculates the mass of inclusions in steel.

Eq. 2 calculates the volume of one inclusion assuming they are spherical.

Eq. 3 calculates the total number of inclusions available in steel.

Eq. 4 calculates the total number of inclusions available in the surface layer (assumed to be 2 μm on each side). Note that these inclusions can only participate in the initial nucleation.

Eq. 5 and Eq. 6 are used to calculate the total surface area of the strip.

Eq. 7 calculates the number of inclusions needed at the surface to meet the target nucleation rate.

Eq. 8 is used to calculate the percentage of total inclusions available at the surface which must participate in the nucleation process. Note if this number is great than 100%, then the number of inclusions at the surface is not sufficient to meet target nucleation rate.

The invention claimed is:

1. A thin steel strip of low carbon steel produced by twin roll casting to a thickness of less than 5mm and formed of a solidified steel containing solidified oxide inclusions distributed such that surface regions of the strip to a depth of 2 microns from the surface contain such inclusions to a per unit area density of at least 120 inclusions/$mm^2$.

2. The thin steel strip as claimed in claim 1 wherein the majority of the solidified steel is a silicon/manganese killed steel and the inclusions comprise any one or more of MnO, $SiO_2$ and $Al_2O_3$.

3. The thin steel strip as claimed in claim 1 wherein the majority of the inclusions range in size between 2 and 12 microns.

4. A thin steel strip of low carbon steel produced by twin roll casting to a thickness of less than 5mm and formed of a solidified steel containing solidified oxide inclusions distributed such that surface regions of the strip to a depth of 2 microns from the surface contain such inclusions to a per unit area density of at least 120 inclusions/$mm^2$wherein the solidified steel has an oxygen content reflective of total oxygen content in the range 100 ppm to 250 ppm and a free oxygen content between 30 and 50 ppm in the molten steel from which the strip is made.

5. A thin steel strip of low carbon steel produced by twin roll casting to a thickness of less than 5mm and formed of a solidified steel containing solidified oxide inclusions distributed such that surface regions of the strip to a depth of 2 microns from the surface contain such inclusions to a per unit area density of at least 120 inclusions/$mm^2$wherein the solidified steel has an oxygen content reflective of total oxygen content in the range 70 ppm to 250 ppm and a free oxygen content between 20 and 60 ppm in the molten steel from which the strip is made.

6. A thin steel strip of low carbon steel produced by twin roll casting of molten metal with slag having basicity less than 0.34 to a thickness of less than 5mm and formed of a solidified steel containing solidified oxide inclusions distributed such that surface regions of the strip to a depth of 2 microns from the surface contain such inclusions to a per unit area density of at least 120 inclusions/$mm^2$.

7. The thin steel strip as claimed in claim 6 wherein the majority of the solidified steel is a silicon/manganese killed steel and the inclusions comprise any one or more of MnO, $SiO_2$ and $Al_2O_3$.

8. The thin steel strip as claimed in claim 6 wherein the majority of the inclusions range in size between 2 and 12 microns.

* * * * *